United States Patent [19]

Long

[11] 4,242,977

[45] Jan. 6, 1981

[54] ANCHOR GUIDE

[76] Inventor: George W. Long, 23241 Collins St., Woodland Hills, Calif. 91364

[21] Appl. No.: 898,148

[22] Filed: Apr. 20, 1978

[51] Int. Cl.[2] ..... B63B 21/22

[52] U.S. Cl. ..... 114/210

[58] Field of Search ..... 114/210, 242, 243, 253, 114/293, 294, 179, 180, 181, 101; 308/DIG. 9, 243; 9/1.1, 1.7

[56] References Cited

U.S. PATENT DOCUMENTS

| | | | |
|---|---|---|---|
| 719,124 | 1/1903 | Marshall | 114/101 |
| 2,686,155 | 8/1954 | Willis | 308/DIG. 9 |
| 3,509,847 | 5/1970 | Persinger | 114/210 |
| 3,675,608 | 7/1972 | Webb | 114/210 |

*Primary Examiner*—Trygve M. Blix
*Assistant Examiner*—Winston H. Douglas
*Attorney, Agent, or Firm*—Christie, Parker & Hale

[57] ABSTRACT

An anchor guide comprises an elongated tube which is slidable axially inside a collar hinged to a bracket attached to a boat deck. A boat anchor is secured to an anchor line which passes through the tube and over a roller located inside the tube immediately above the hinge axis of the collar. The anchor is retrieved by pulling on the anchor line to pull the shank of the anchor into the tube until the body of the anchor strikes the bottom of the tube, after which continued tension on the anchor line pivots the collar about the hinge axis to lift the tube and the anchor, while causing the tube and anchor to slide through the collar toward the boat deck, reducing the amount of force required to lift the anchor. In one embodiment, the top edge of the collar and the working surface of the roller are sufficiently close to the hinge axis of the collar that the tube can remain in an essentially vertical position until the shank of the anchor is inside the tube, which reduces the chance of the anchor catching on the tube as the anchor is being pulled into the tube. In another embodiment, the roller is freely rotatable about its axis, as well as being movable longitudinally and angularly relative to the tube, which facilitates pulling a chain-type anchor line over the roller without the links of the chain catching on the roller.

30 Claims, 5 Drawing Figures

ANCHOR GUIDE

BACKGROUND

This invention relates to anchor guides for boats, and more particularly to apparatus for assisting the boat owner in retrieving and lifting an anchor onto a boat and for holding the anchor in place onboard the boat.

In the past, anchor guides have been provided for assisting a boat owner in retrieving and lifting an anchor onboard a boat. Such anchor guides are shown, for example, in the following patents:

| U.S. Pat. No. | Patentee |
|---|---|
| 3,242,894 | Anderson |
| 3,509,847 | Persinger |
| 3,577,951 | Smith |
| 3,635,187 | Webb |
| 3,675,608 | Webb |

The present invention provides an improvement over the anchor guides disclosed in these patents.

Prior art anchor guides have a number of disadvantages. Many prior art anchor guides are complicated and too expensive, especially for the small boat owner. Some hinged anchor guides have a tube for receiving the shank of an anchor. The tube is hinged to the boat and the tube can pivot to lift the anchor onboard the boat. Some hinged anchor guides require a substantial amount of leverage to rotate the tube about its axis to lift a heavy anchor onboard the boat.

Small boat owners who use their boat for fishing often have more than one anchor, and they frequently pull in their anchors in order to move the boat from time to time. A large amount of leverage required to lift a heavy anchor, especially at the end of a hinged tube, can be tiring to the boat owner. In some instances a power winch is even needed to assist pivoting the tube and anchor about the hinge axis.

Anchor guides having a hinged tube often are designed such that the tube can hang in a generally vertical position when the boat is anchored. When the anchor line is initially pulled through the tube, the pull on the line can cause the bottom of the tube to kick away from the boat into an angular position which makes it difficult to pull the shank of the anchor into the tube. Often the top of the anchor shaft will catch on the bottom of the tube.

Some prior art anchor guides also have a roller over which the anchor line passes. In many instances such anchor guides cannot be used with a chain-type anchor line, because the links of the chain can catch on the roller.

The present invention provides an anchor guide which substantially reduces the complexity and cost of manufacturing an anchor guide when compared with prior art anchor guides. The present anchor guide also eliminates the deficiencies characteristic of prior art anchor guides described above.

SUMMARY OF THE INVENTION

One embodiment of the present invention comprises an anchor guide having an elongated tube for receiving the shank of an anchor secured to a tension line passing through an entrance opening at one end of the tube, a bracket for being mounted adjacent an edge of a boat deck, and an elongated collar disposed around the tube. The tube is slidable lengthwise relative to the collar, and the collar is hinged to the bracket for allowing the collar and the tube to pivot relative to the bracket about an axis transverse to the length of the collar. The length of the collar is greater from the pivot axis to a first end of the collar adjacent the entrance opening of the tube than from the pivot axis to a second end of the collar opposite the entrance opening of the tube. This arrangement minimizes the leverage applied to the tube by the collar when a tension line passing through the tube and collar is pulled to draw an anchor toward the entrance opening of the tube. By minimizing such leverage, the tube can stay in an essentially vertical position when tension is being applied to the tension line, and as a result, the chance of the anchor catching on an entrance end of the tube is minimized. The tube and collar can pivot together through an angle while the tube slides lengthwise relative to the collar for reducing the amount of force applied to the tension line to lift the anchor onboard the boat deck.

In another embodiment, the invention includes a roller secured to the tube adjacent the second end of the collar. The roller is rotatable about its axis, as well as being movable angularly and longitudinally with respect to the tube. The freedom of movement provided by such a roller facilitates pulling a chain-type anchor line over the roller without the links of the chain catching on the roller.

These and other aspects of the invention will be more fully understood by referring to the following detailed description and the accompanying drawings.

DRAWINGS

DETAILED DESCRIPTION

Figure 1:
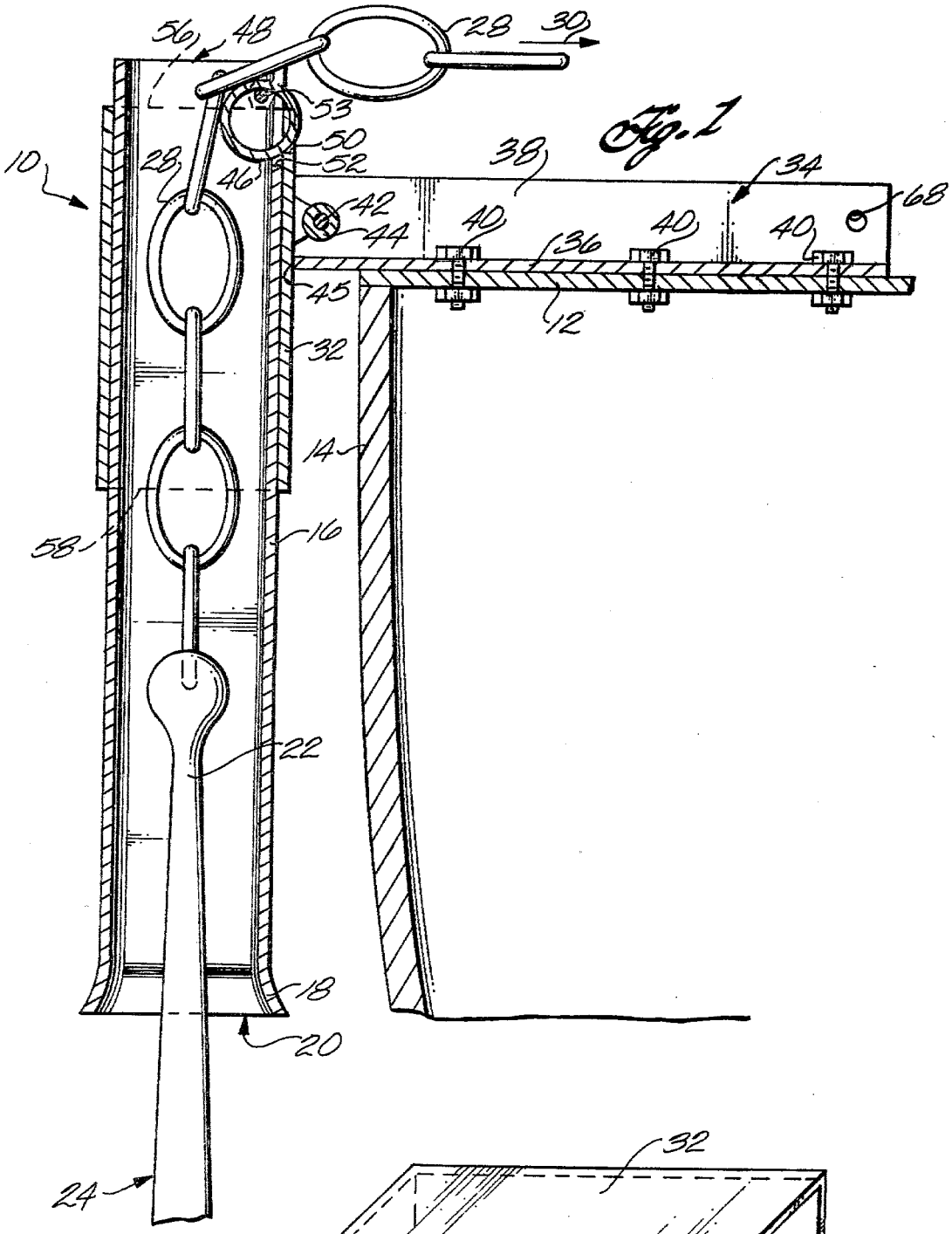
FIG. 1 is a fragmentary cross-sectional side elevation view showing an anchor guide according to this invention in a vertical rest position adjacent the side of a boat.

Referring to FIG. 1, an anchor guide 10, according to principles of this invention, is mounted on a deck 12 of a boat 14 adjacent an edge of the boat. The anchor guide includes an elongated tube 16 having a flaired end 18 at an entrance opening 20 of the tube. The flaired end of the tube facilitates drawing the shank 22 of an anchor 24 upwardly into the tube. The anchor 24 also includes a heavy main body or weight 26 (shown in FIGS. 2 and 3) affixed to the lower end of the shank, and an anchor line, shown as a chain 28, secured to the upper end of the shank. The shank of the anchor can be drawn upwardly through the hollow interior of the tube 16 in response to a pulling force in the direction of an arrow 30 shown in FIG. 1.

The tube 16 is slidable axially within an elongated collar 32 which is hinged to an end of an elongated bracket 34. The collar can be tubular, as shown, to closely surround the exterior of the tube 16. In the embodiment shown, the tube and the collar are rectangular in transverse cross-section, with the tube making a close sliding fit inside the collar.

The bracket 34 preferably is of U-shaped channel configuration, having a flat base 36 and elongated, spaced apart, parallel upright side walls 38 projecting upwardly along opposite edges of the base 36. A plurality of axially spaced apart fasteners 40 extend through corresponding openings in the base 36 and into the boat deck 12 for securing the bracket 34 to an end of the deck. As illustrated best in FIG. 1, an end portion of the bracket projects away from an end of the boat so that the tube 16 can hang downwardly in an essentially vertical position adjacent the side of the boat, while the tube is spaced sufficiently from the side of the boat that the body 26 of the anchor does not strike the side of the boat.

Figure 2:
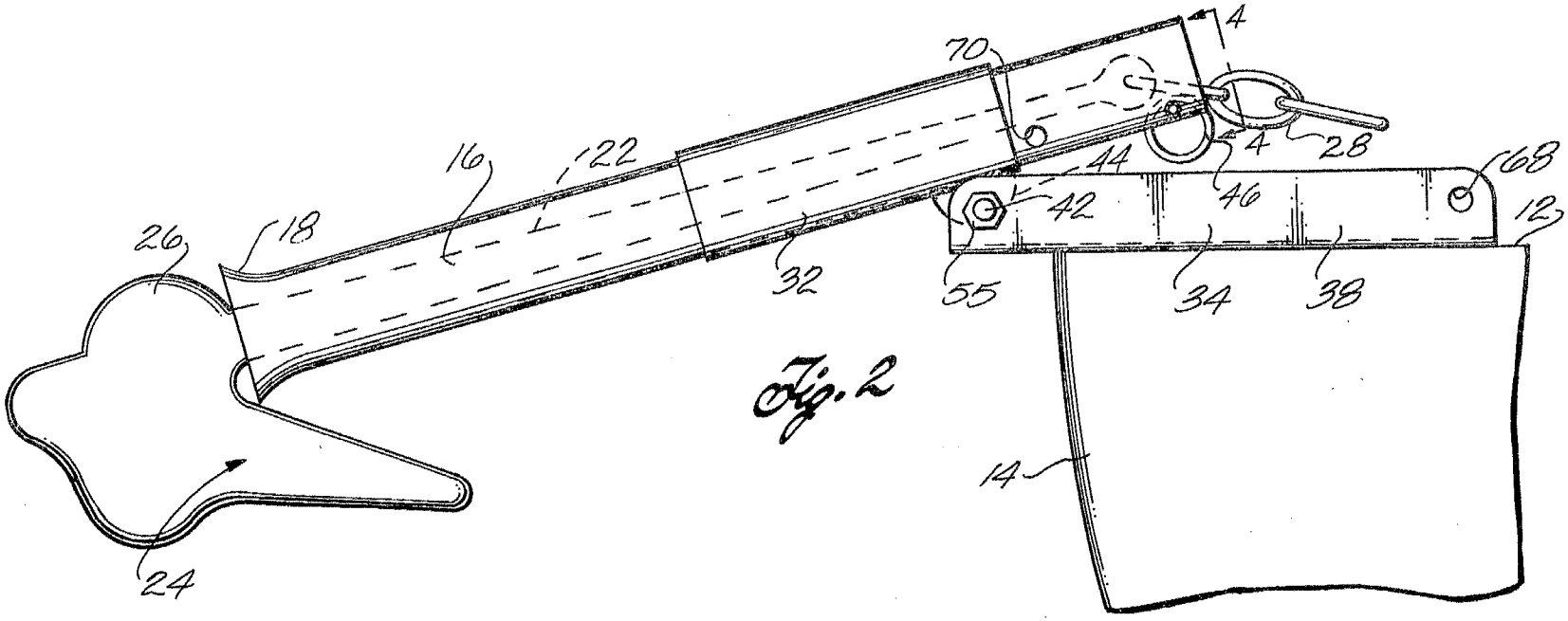
FIG. 2 is a fragmentary side elevation view similar to FIG. 1 showing the anchor guide pivoted into a position for assisting the lifting of an anchor onboard the boat.
Figure 3:
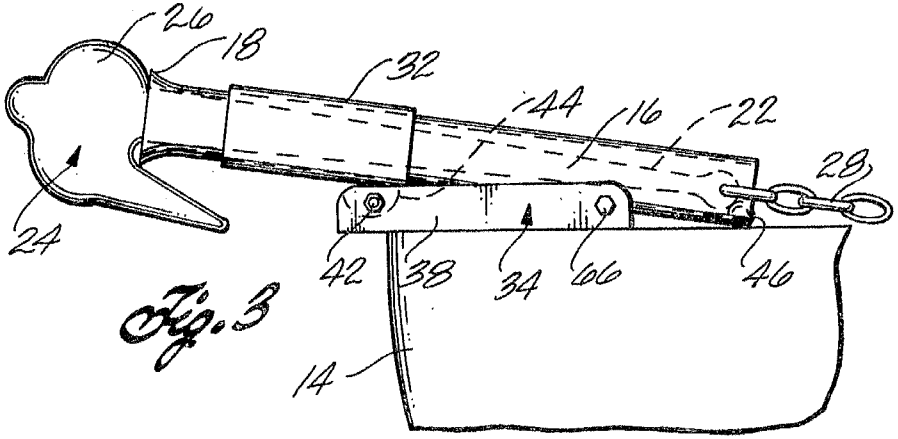
FIG. 3 is a fragmentary side elevation view similar to FIGS. 1 and 2 showing the anchor guide in a locked position holding the retrieved anchor onboard the boat.

As shown best in FIG. 1, the collar 32 is hinged to an end portion of the bracket 34 by an elongated hinge pin 42 extending between opposite side walls 38 of the bracket. The hinge pin is cylindrical, and the ends of the hinge pin are rigidly affixed to the side walls of the bracket. An elongated tubular rotatable shaft 44 surrounds the hinge pin 42. The exterior of the shaft 44 is welded to an edge of the collar facing the bracket. The inside surface of the shaft is circular to closely match the outside surface of the hinge pin for allowing the shaft to rotate about the hinge pin. The hinge allows the collar to pivot through an angle of more than 90° about an axis through the hinge pin. The collar can pivot from an essentially vertical position shown in FIG. 1 to an angular position slightly above horizontal as shown in FIG. 3. The body of the collar pivots within the confines of the upright side walls 38 of the bracket. The transverse axis about which the collar pivots is spaced from the edge of the collar nearest the bracket. Pivoting of the collar about the transverse axis rotates the tube 16 with the collar, as well as lifting an anchor disposed in the tube, as shown in FIGS. 2 and 3. An edge 45 of the bracket engages the side wall of the collar adjacent the bracket for acting as a stop for releasably holding the collar 32 in an essentially vertical rest position illustrated in FIG. 1.

Figure 4:
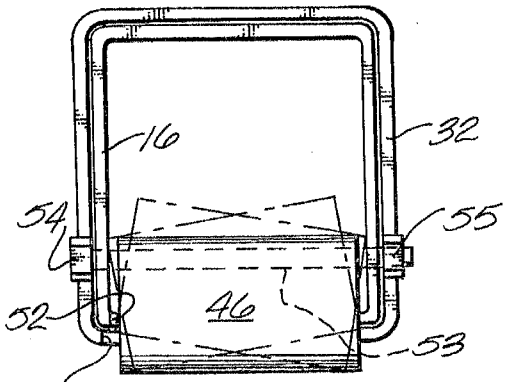
FIG. 4 is an end elevation view taken on line 4—4 of FIG. 2.

A roller 46 is secured adjacent an exit opening 48 of the tube at the end of the tube opposite the entrance opening 20. The roller is secured inside the tube immediately above a top end 56 of the collar when the tube is held in its vertical position illustrated in FIG. 1. Preferably, the roller is secured inside the tube closest those side walls of the tube and collar which face toward and are immediately adjacent the hinge axis of the collar. In the embodiment shown, a recess 50 is formed in the side wall of the collar adjacent the hinge axis, and a corresponding recess 52 is formed in a corresponding side wall of the tube. This arrangement allows the roller 46 to protrude into an upper interior portion of the tube, as well as being able to extend past the plane of the side walls of the tube and collar located adjacent the hinge axis. The roller 46 is held captive inside the tube by a shaft 53 which is rigidly affixed between opposite side walls of the tube. The inside diameter of the roller 46 is substantially greater than the outside diameter of the shaft 53 so that the roller can "wobble" relative to the tube. That is, the roller is free to rotate about the shaft 53, as well as to move longitudinally with respect to the shaft 53. The roller also has a width which is shorter than the lateral distance between the opposite side walls of the tube so that the roller can move back and forth between angular positions relative to a horizontal axis through the shaft 53. The wobbling angular motion of the roller is illustrated best in FIG. 4.

The shaft 53 is formed by the shank portion of a fastener secured between opposite side walls of the tube 16. The fastener includes a head 54 adjacent one side wall of the tube and a nut 55 tightened against an opposite side wall of the tube. The fastener head 54 and nut 55 act as a stop by engaging the top edge 56 of the collar 32 when the tube slides under gravity through the collar to the rest position illustrated in FIG. 1. In this position, the upper working surface of the roller 46 is held close to the top edge of the collar.

In one embodiment of the invention, the roller or other working surface over which the anchor line or chain 28 is pulled is located sufficiently close to the pivot axis of the collar that leverage caused by pulling in on the anchor line, so as to lift the anchor, does not appreciably rotate the tube away from its vertical rest position at least until the shank of the anchor is pulled inside the tube. In the embodiment shown, the top edge 56 or second end of the collar is located only a short distance above the axis through the hinge pin 42. The tube, in its rest position shown in FIG. 1, positions the roller 46 close to the top edge 56 of the collar which, in turn, locates the roller relatively close to the hinge axis. It is desirable that the length of the collar be greater from the hinge axis to a bottom edge 58 or first end of the collar adjacent the entrance opening of the tube than from the hinge axis to the top edge 56 of the collar. Such a structure locates the roller close to the hinge axis of the collar, while the collar is sufficiently long to maintain the tube in an essentially vertical rest position shown in FIG. 1. The distance between the hinge axis and the bottom edge 58 of the collar 32 is preferably more than twice the distance from the top of the collar to the hinge axis. The distance from the hinge axis to the top edge of the roller (as the roller is shown in FIG. 1) is desirably no more than the distance from the hinge axis to the bottom edge of the collar.

In one embodiment of an anchor guide for use on small boats, the distance from the top edge of the roller 46 to the hinge axis is no more than about 3 inches and is preferably about 2 inches or less. In the same embodiment, the distance from the top edge 56 of the collar 32 to the hinge axis is no more than about 2 inches, and is preferably less than about 1½ inches.

In using the anchor guide of this invention, the anchor 24 is drawn in from its anchored position while the tube 16 is held in the vertical position shown in FIG. 1. By applying a pulling force to the chain 28 in the direction of the arrow 30 shown in FIG. 1, the upper portion of the shank 22 of the anchor can be drawn through the entrance opening 20 of the tube and into the interior of the tube 16. Since the top edge of the collar 32 and the working surface of the roller 46 are located close to the axis through the hinge pin 42, the pulling force applied to the chain does not pivot the collar appreciably away from its essentially vertical position shown in FIG. 1 while the shank of the anchor is being pulled through the tube. By enabling the tube 16 to be held in such a substantially vertical position, even while such a pulling force is being applied to the chain, the anchor can be drawn into the tube with great reliability without catching on an edge of the tube. This overcomes a problem of prior art anchoring guides in which a pulling force applied to an anchor line forces the anchor-retrieving tube to kick away or pivot angularly away from the side of the boat into an angular position which greatly increases the chance of the top of the anchor catching on the tube, preventing it from being pulled into the interior of the tube.

A continued upward pulling force on the anchor chain 28 pulls the shank 22 of the anchor through the interior of the tube 16 until the body 26 of the anchor strikes the bottom of the tube 16. At that instant continued force on the chain causes the collar 32 to immediately pivot outwardly away from the boat, as illustrated in FIG. 2, and simultaneously allows the tube 16 to be slid lengthwise through the collar toward the boat to assist the user in lifting the anchor onboard the boat. The pivoting action of the collar about the hinge axis and the immediate sliding of the tube through the collar occurs essentially simultaneously. Continued further pulling on the anchor chain 28 slides the tube 16 completely through the interior of the collar to the stored position illustrated in FIG. 3. The sliding movement of the tube within the collar, as the collar rotates upwardly, assists the boat owner greatly in being able to lift the heavy anchor, and it reduces by a factor of about 3 to 5 the amount of force required to lift the anchor onto the boat when compared with a hinged anchor guide tube not having the slidable tube and collar. The force required to lift the anchor with the present invention is sufficiently reduced that the anchor can be lifted easily by a person pulling in on the chain rather than requiring a power winch.

The anchor can be held onboard the boat by light tension on the anchor line, and the anchor can be easily deployed by releasing the tension on the anchor line, which allows the tube to slide through the collar under gravity while the collar pivots the tube into an essentially vertical position.

The wobbly action of the roller 46 also assists in retrieving the anchor, especially an anchor secured to a chain. In many anchor guides the use of a chain is not recommended because the links of a chain can frequently catch on a roller or sheave at the top of the guide tube. I have discovered that the wobbly roller 46 of this invention provides sufficient freedom of movement that a chain used on an anchor line will not snag or catch on the roller. The wobbly roller also can allow a portion of the shank of a relatively long anchor to be pulled through the tube and past the roller.

Figure 5:
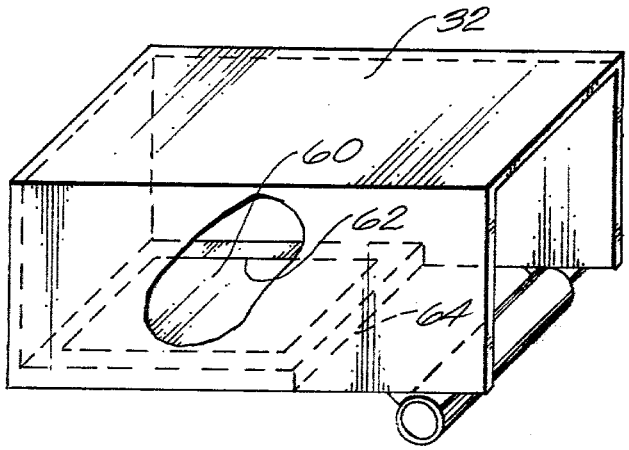
FIG. 5 is a perspective view showing an alternate form of the invention providing means for lubricating a tube for receiving and lifting an anchor.

The anchor guide of this invention also can be used with a lubricating device illustrated in FIG. 5 in which a solid lubricating pad 60 is secured inside a recess 62 in a floor 64 of the collar 32. In this embodiment, the outside wall of the tube 16 constantly runs back and forth on the solid lubricant 60 to facilitate easily sliding the tube through the collar which, in turn, assists the user in easily lifting the anchor.

The anchor guide also includes means for securing the anchor in a locked position for storage, as illustrated in FIG. 3, once the anchor has been lifted onboard the boat. The tube 16 is locked to the bracket 34 by a bolt 66 extending through corresponding holes 68 in the outside side walls 38 of the bracket. The bolt also extends through corresponding holes 70 in the tube 16 and can be locked by tightening the nut (not shown) on an end of the bolt 66 against the side wall of the tube.

The present invention has been described in the context of an anchor guide for use with small boats, but the invention is also applicable to much larger vessels, barges, etc. The anchor guide also will accept various commercial anchors and also easily uses line, cable or chain, or a combination of two or more.

I claim:

1. An anchor guide comprising:

an elongated tube for receiving the shank of an anchor secured to a tension line passing through an entrance opening at one end of the tube;

a bracket for being mounted adjacent an edge of a boat deck;

an elongated collar disposed around the tube so that the tube is confined within the collar and is slidable lengthwise relative to the collar; and means hinging the collar to the bracket for allowing the collar to pivot relative to the bracket about an axis transverse to the length of the collar, the length of the collar being greater from the transverse pivot axis to a first end of the collar adjacent the entrance opening of the tube than from the transverse pivot axis to a second end of the collar opposite the entrance opening of the tube, the tube and collar pivoting together through an angle while the tube slides lengthwise relative to the collar so as to reduce the amount of force applied to the tension line to lift the anchor onboard the boat deck when the shank of the anchor is received in the tube.

2. Apparatus according to claim 1 in which the length of the collar from the transverse pivot axis to the first end of the collar is at least two times as long as the distance from said axis to the second end of the collar.

3. Apparatus according to claim 1 including a roller secured to the tube adjacent the second end of the collar for engaging the tension line secured to a shank of the anchor.

4. Apparatus according to claim 3 including a recess in a wall of the tube and a corresponding recess in a corresponding wall of the collar for receiving a portion of the roller to enable at least a portion of the roller to fit inside the tube and the collar.

5. Apparatus according to claim 3 in which the tube is slidable to a rest position relative to the collar where the roller is adjacent the second end of the collar, and where the tube is in a substantially vertical orientation substantially at a right angle relative to the length of the bracket, and in which a shank of the anchor can be pulled into the tube in response to pulling on the tension line secured to the anchor and passing through the tube and over the roller, the roller, while the tube is in said vertical orientation, being sufficiently close to the transverse pivot axis that the tube can remain essentially in said vertical orientation until the shank of the anchor can be pulled into the tube.

6. Apparatus according to claim 5 in which the roller is sufficiently close to the transverse pivot axis that the tube can remain essentially in said vertical orientation until the shank of the anchor can be pulled through the tube to the vicinity of the roller.

7. Apparatus according to claim 3 including stop means for releasably holding the tube in a fixed position relative to the collar, the tube being slidable under gravity to said fixed position and into contact with the stop means.

8. Apparatus according to claim 7 in which the distance between a working surface of the roller and the transverse pivot axis, when the tube is in said fixed position, is less than the distance from the pivot axis to the first end of the collar.

9. Apparatus according to claim 7 in which the distance between a working surface of the roller and the transverse pivot axis, when the tube is in said fixed position, is less than about 3 inches.

10. Apparatus according to claim 1 in which the distance between the second end of the collar and the transverse axis is less than about 2 inches.

11. Apparatus according to claim 1 in which the collar is a tubular member surrounding the tube.

12. Apparatus according to claim 11 in which the collar and the tube are rectangular in transverse cross-section.

13. Apparatus according to claim 1 including lubricating means between the tube and the collar.

14. Apparatus according to claim 1 including a roller mounted on a shaft extending across the tube adjacent the second end of the collar so that the roller rotates freely about the axis of the shaft as well as moves angularly with respect to the tube and moves axially with respect to the length of the tube.

15. Apparatus according to claim 14 in which the inside diameter of the roller is substantially greater than the outside diameter of the shaft to allow the roller to freely move lengthwise relative to the tube as well as to freely rotate about the axis of the shaft.

16. Apparatus according to claim 15 in which the length of the roller is shorter than the distance between opposite side walls of the tube for allowing the roller to move angularly with respect to the tube.

17. Apparatus according to claim 14 in which the axis of the shaft is substantially parallel to the transverse pivot axis of the collar.

18. Apparatus according to claim 1 in which the transverse pivot axis is spaced laterally from an adjacent side wall of the tube.

19. Apparatus according to claim 1 in which the collar essentially confines the tube against angular movement relative to the collar.

20. Apparatus according to claim 19 in which the tube is substantially longer than the collar and the tube makes a sliding fit inside the collar.

21. Apparatus according to claim 1 in which the collar confines the tube only to sliding movement lengthwise with respect to the collar.

22. Apparatus according to claim 21 in which the tube is freely slidable in the collar.

23. Apparatus according to claim 22 including stop means on the tube for engaging the collar.

24. Apparatus according to claim 22 in which the transverse pivot axis is stationary.

25. Apparatus according to claim 24 including a roller secured to the tube adjacent the second end of the collar for engaging the tension line.

26. An anchor guide comprising:

an elongated tube for receiving the shank of an anchor passing through an entrance opening at one end of the tube;

a bracket for being mounted adjacent an edge of a boat deck;

an elongated collar disposed around the tube, the tube being slidable lengthwise relative to the collar, the collar having a first end adjacent the entrance opening of the tube and a second end opposite the entrance opening of the tube;

means hinging the collar to the bracket for allowing the collar and the tube to pivot relative to the bracket about a pivot axis transverse to the length of the collar and between said first and second ends of the collar; and a roller mounted on a shaft extending across the tube adjacent the second end of the collar so that the roller engages a tension line secured to the shank of the anchor, the roller being mounted to rotate freely about the axis of the shaft as well as to move angularly relative to the tube and to move longitudinally relative to the longitudinal axis of the tube.

27. Apparatus according to claim 26 in which the inside diameter of the roller is substantially greater than the outside diameter of the shaft for allowing the roller to freely move longitudinally relative to the tube as well as to freely rotate about the axis of the shaft.

28. Apparatus according to claim 27 in which the length of the roller is shorter than the distance between opposite side walls of the tube for allowing the roller to move angularly relative to the tube.

29. Apparatus according to claim 28 including a recess in a wall of the tube, and a recess in a corresponding wall of the collar for receiving a portion of the roller to enable at least a portion of the roller to fit inside the tube and the collar.

30. Apparatus according to claim 26 in which the tube is slidable to a rest position relative to the collar where the roller is adjacent the second end of the collar, and where the tube is in a substantially vertical orientation substantially at a right angle relative to the length of the bracket, and in which a shank of an anchor can be pulled into the tube in response to pulling on the tension line secured to the anchor and passing through the tube and over the roller, the roller, while the tube is in said vertical orientation, being sufficiently close to the transverse pivot axis that the tube can remain essentially in said vertical orientation until the shank of the anchor can be pulled into the tube.

* * * * *